US006738991B1

(12) United States Patent
Dandreo et al.

(10) Patent No.: US 6,738,991 B1
(45) Date of Patent: May 25, 2004

(54) FLUSHABLE TODDLER TOILET CHAIR LINER

(76) Inventors: Julie E. Dandreo, 1004 S. Olive St., Ottawa, KS (US) 66067; Daniel W. Dandreo, 1004 S. Olive St., Ottawa, KS (US) 66067; Blair Sutton, P.O. Box 418, Ottawa, KS (US) 66067

( * ) Notice: Subject to any disclaimer, the term of this patent is extended or adjusted under 35 U.S.C. 154(b) by 0 days.

(21) Appl. No.: 10/304,481

(22) Filed: Nov. 26, 2002

(51) Int. Cl.[7] ..... A47K 11/06
(52) U.S. Cl. ..... 4/484
(58) Field of Search ..... 4/452, 484

(56) References Cited

U.S. PATENT DOCUMENTS 3,936,890 A 2/1976 Oberstein
4,011,606 A * 3/1977 Scrafield et al. ..... 4/457
4,759,086 A 7/1988 Booth-Cox
4,882,794 A 11/1989 Stewart, III
5,265,285 A 11/1993 Loebbert
5,545,681 A * 8/1996 Honkonen ..... 524/115
5,611,092 A 3/1997 Van Dusen
5,778,458 A 7/1998 Speelman
D402,739 S 12/1998 McClements
6,115,855 A 9/2000 Lorenzo
6,523,187 B1 * 2/2003 Brink et al. ..... 4/484
6,532,605 B1 * 3/2003 Howell ..... 4/484

* cited by examiner

*Primary Examiner*—Charles E. Phillips
(74) *Attorney, Agent, or Firm*—Dale J. Ream

(57) ABSTRACT

A potty chair liner for a toddler toilet chair includes a container having an impermeable outer layer, a permeable inner layer, and an absorbent core sandwiched therebetween. The outer layer includes a closed bottom and a continuous side wall having a lip for positioning the container on the toddler toilet chair and defining an open top. The outer layer is formed of a soluble material such as polyvinyl alcohol coated with a polymeric film having hydrolytic degradability additives that allow the soluble material to dissolve only when the film is exposed to an excess of water and is thus degraded. The absorbent core includes polyacrylate crystals and cellulosic fibers.

3 Claims, 6 Drawing Sheets

FLUSHABLE TODDLER TOILET CHAIR LINER

BACKGROUND OF THE INVENTION

This invention relates generally to disposable waste containment devices and, more particularly, to a liner that is flushable and biodegradable for use with a toddler toilet chair.

The toilet training of toddlers is often a frustrating, inconvenient, and unsanitary aspect of child rearing that is dreaded by many parents. This process usually involves use of a toddler potty chair or toilet seat device and requires a waste receptacle to be dumped and cleaned after each use. Various devices and disposable liners have been proposed in the art for simplifying or sanitizing this repetitive cleaning process. Although assumably effective for their intended purposes, the existing bags or liners are not suitable to be flushed down a conventional toilet either by a parent or the child.

Therefore, it is desirable to have a potty chair liner that may be flushed down a conventional toilet without clogging the plumbing fixtures and which is biodegradable in the sewer system. Further, it is desirable to have a potty chair liner which does not dissolve upon contact with bodily fluids but rather upon exposure to an excess volume of water, such as when deposited in a toilet.

SUMMARY OF THE INVENTION

A potty chair liner according to the present invention includes a container having a configuration complementary to that of a toddler toilet chair. The container includes an impervious outer layer, a permeable inner layer, and an absorbent core sandwiched between the inner and outer layers. The outer layer is formed substantially of a polyvinyl alcohol material which is water soluble. However, the polyvinyl alcohol outer layer is coated with a polymeric film that inhibits dissolution of the polyvinyl alcohol until the film is sufficiently hydrolytically degraded. The polymeric film includes hydrolytic degradability additives which contribute to a hydrolytic chemical reaction when the film is exposed to an excess volume of water. As the film degrades, the outer layer dissolves in the water, e.g. in the tap water of a toilet. In addition, an adhesive used to connect the inner and outer layers is water soluble such that the layers will separate when flushed down a toilet.

Therefore, a general object of this invention is to provide a potty chair liner for a toddler toilet chair that may be flushed down a conventional toilet.

A further object of this invention is to provide a potty chair liner, as aforesaid, in which an outer layer includes a polymeric film that inhibits solubility until exposed to an excess volume of water.

Another object of this invention is to provide a potty chair liner, as aforesaid, which minimizes the force required to remove the liner from a toddler toilet chair.

Still another object of this invention is to provide a potty chair liner, as aforesaid, having handles that may be used to remove the liner from a toddler toilet chair.

Yet another object of this invention is to provide a potty chair liner, as aforesaid, in which the handles may be selectively coupled so as to close the container for disposal.

Other objects and advantages of this invention will become apparent from the following description taken in connection with the accompanying drawings, wherein is set forth by way of illustration and example, embodiments of this invention.

DESCRIPTION OF THE PREFERRED EMBODIMENT

Figure 2:
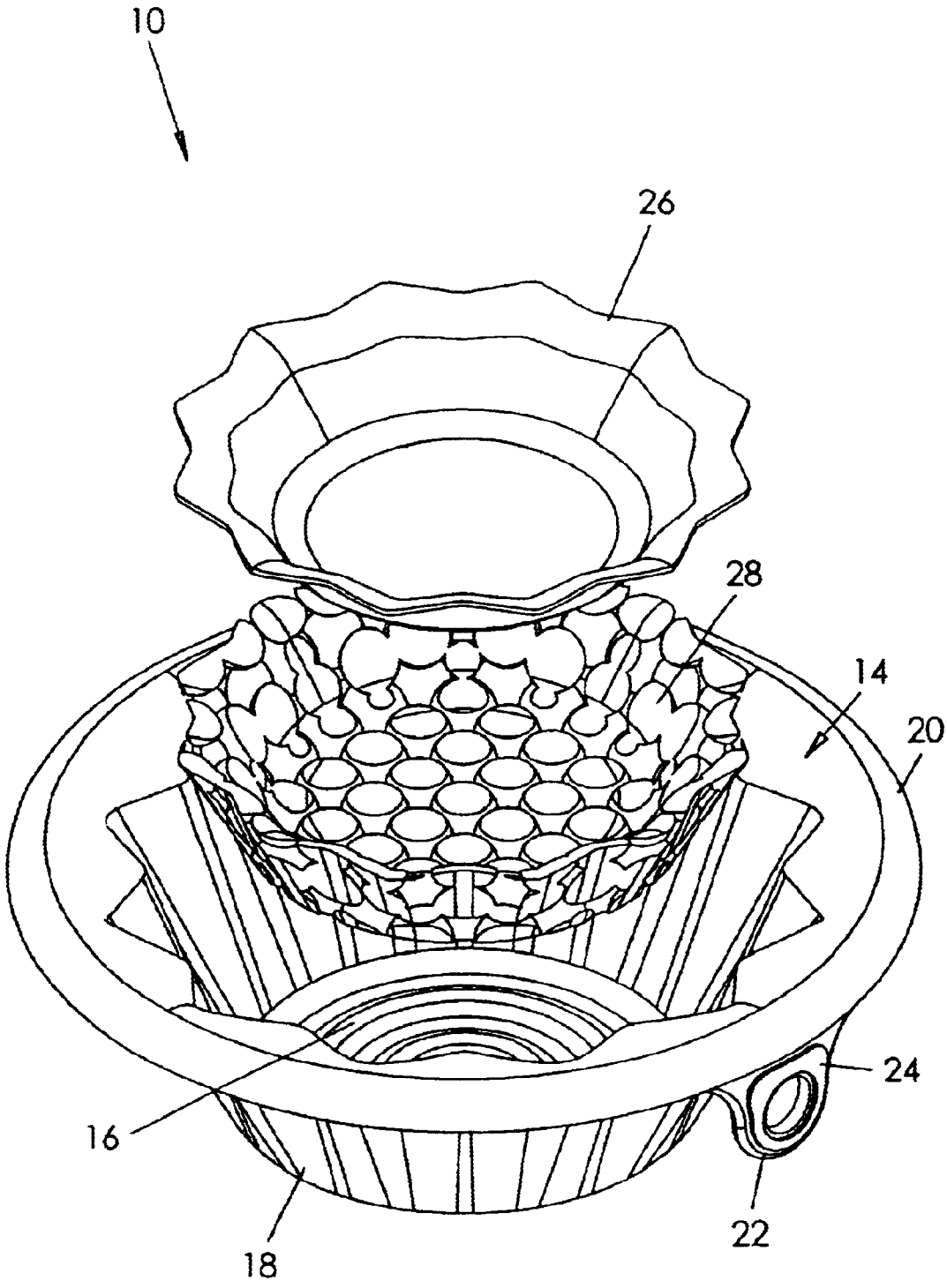
FIG. 2 is an exploded view of the liner as in FIG. 1.
Figure 3A:
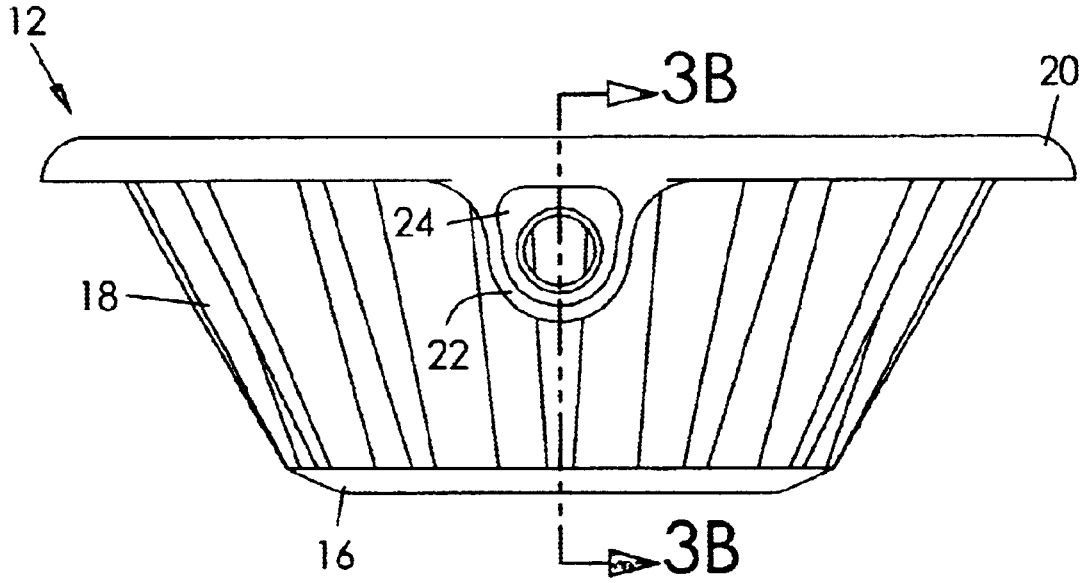
FIG. 3A is a side view of the liner as in FIG. 1.

A potty chair liner according to the present invention will now be described in detail with reference to FIGS. 1 through 6 of the accompanying drawings. A potty chair liner 10 according to one embodiment of the present invention is shown in FIGS. 1 through 4 and includes a container 12 (FIG. 1) having a configuration that is complementary to a traditional toddler toilet training chair (not shown) such that the container 12 may be positioned therein. More particularly, the container 12 includes an impervious outer layer 14 having a bottom 16 and a continuous side wall 18 integrally connected to the bottom 16 and extending generally upwardly therefrom. The side wall 18 includes a lip 20 extending generally outwardly from an upper free edge thereof, the lip having a generally concave configuration (FIGS. 3A and 3B) that is complementary to an upper edge of a toddler toilet chair waste receiving receptacle (not shown) for holding the container in position thereon. The lip 20 defines an open top of the outer layer 14. The bottom 16 includes a diameter smaller than a diameter of the open top such that the side wall 18 slopes outwardly between the bottom 16 and open top for directing waste toward the bottom of the container (FIG. 3A).

Figure 1:
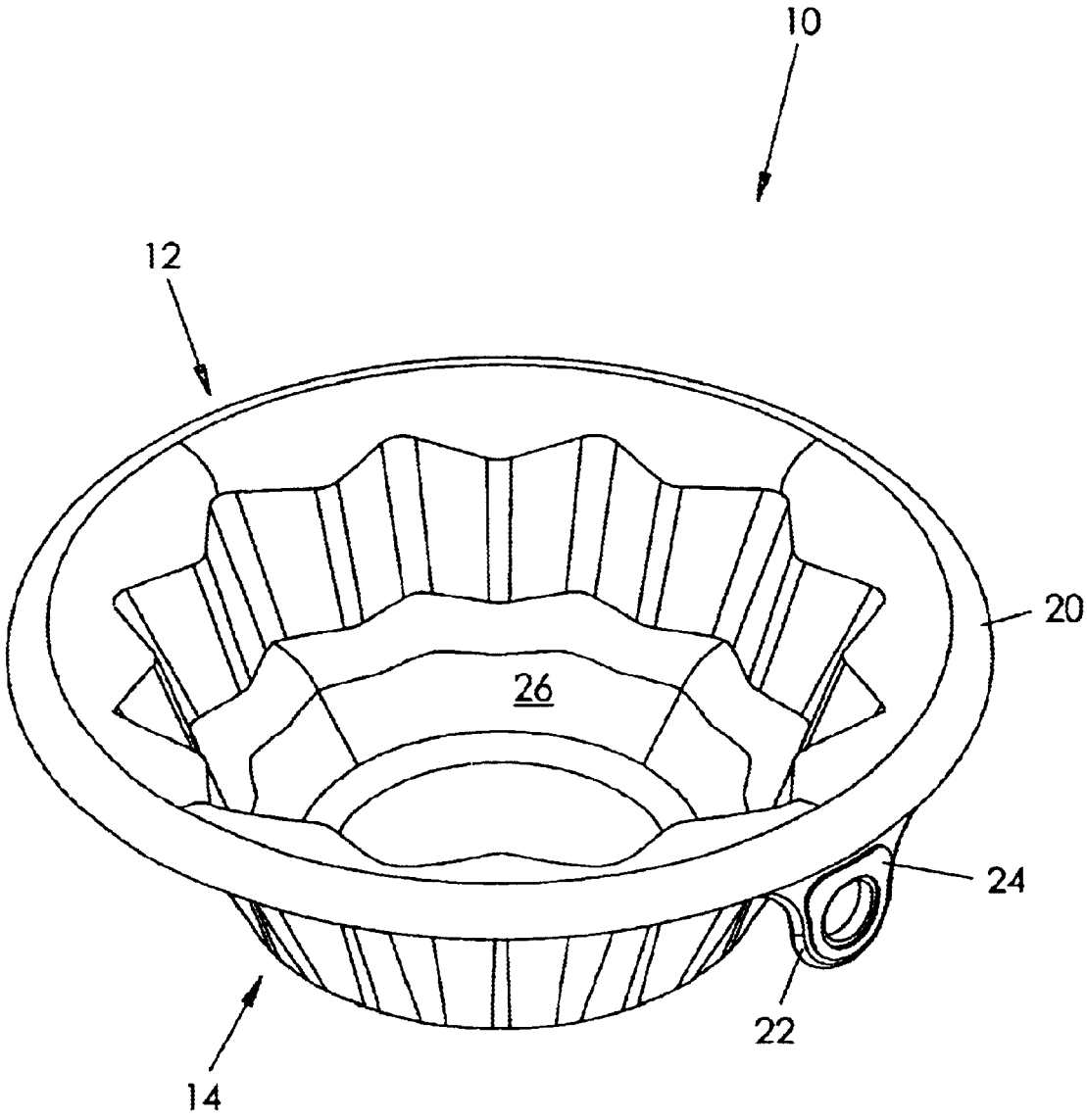
FIG. 1 is a perspective view of a potty chair liner according to one embodiment of the present invention.
Figure 3B:
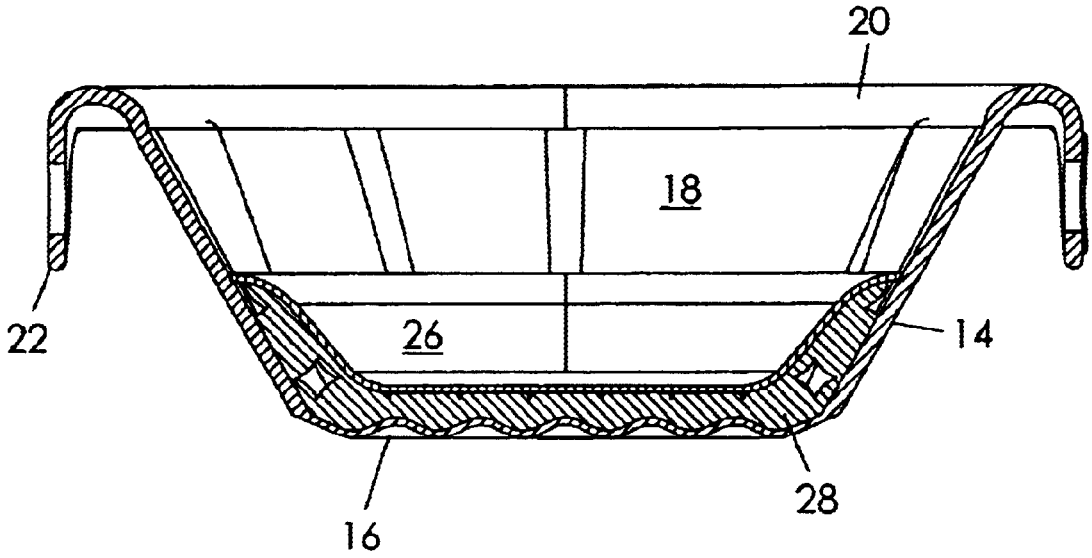
FIG. 3B is a sectional view taken along line 3B—3B of FIG. 3A.

A pair of handles/flanges 22 are integrally connected to the lip 20 of the outer layer 14 and preferably situated opposite one another, although other laterally spaced apart arrangements would also work (FIGS. 1 and 3B). The handles 22 are generally flexible and have a construction substantially similar to a construction of the outer layer 14, as to be described more fully below. Further, one side of at least one of the pair of handles 22 includes an adhesive coating 24 such that the handles 22 may be selectively adhered together to substantially close the open top, such as when the container 12 has received waste-and needs to be disposed of. The handles 22 allow a user to lift the container 12 out of a toddler potty chair waste receptacle and dispose of it without spillage.

Figure 4:
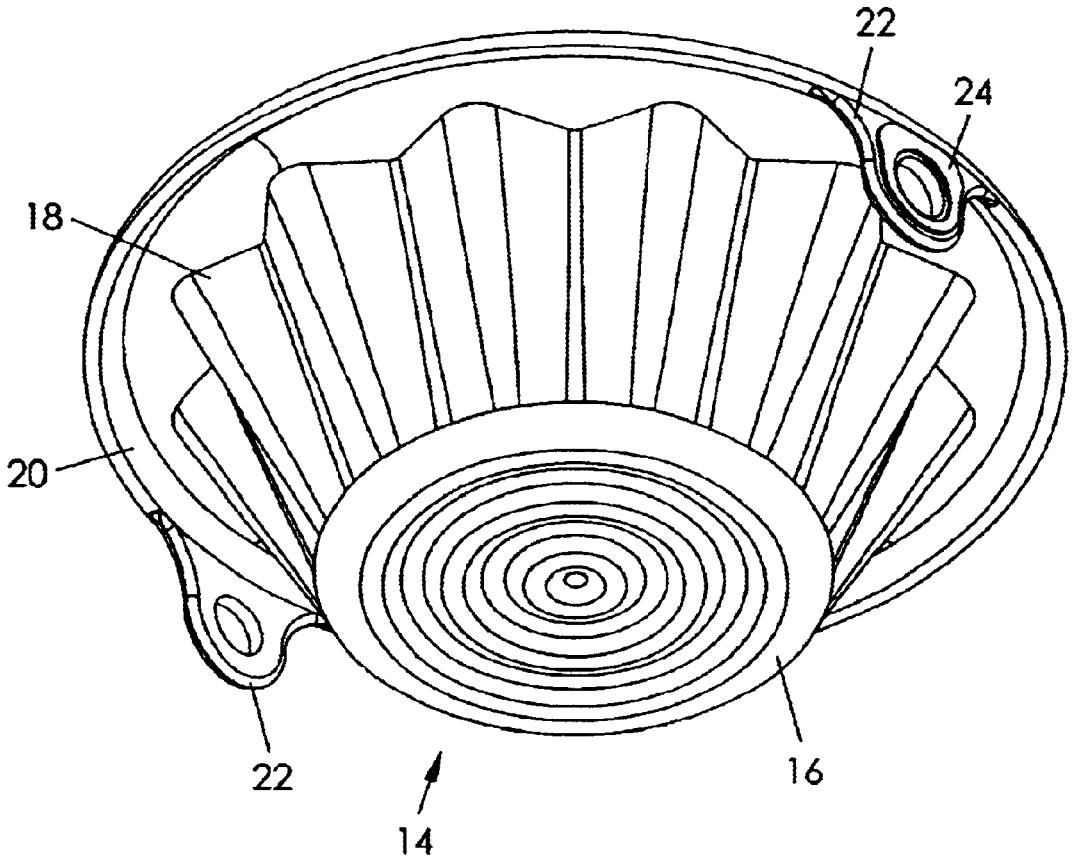
FIG. 4 is a bottom perspective view of the liner as in FIG. 1.

The bottom 16 of the container outer layer 14 includes a pleated configuration so as to minimize cohesion between the bottom 16 and a surface of the potty chair waste receptacle (FIG. 4). When cohesion therebetween is reduced, the outer layer 14 may be constructed out of thinner material without an increased risk of breakage. Thus, the cost of manufacture is reduced. For the same reasons, the side wall 18 also includes a pleated configuration (FIG. 4).

The outer layer 14 is impervious to bodily fluids and solid waste collected by the container 12. More particularly, the outer layer 14 is constructed of polyvinyl alcohol that is coated on both sides with a polymeric film having hydrolytic degrading additives. Polyvinyl alcohol is completely soluble in water and thus needs to be inhibited from dissolving on contact with bodily fluids. The polymer film may be a thermoset or thermoplastic polymer. In their pure state, polymers do not degrade naturally but instead must be chemically induced to degrade. A polymer degrading reaction must be initiated and promoted if polymer degradation is desired. Therefore, a polymer may include specific degradability additives in its formulation to encourage certain types of degrading chemical reactions, e.g. a hydrolytic reaction. In addition, this degradation can be specific to a predetermined pH or ion concentration determinant. Accordingly, the polymer film that coats the polyvinyl alcohol of the outer layer 14 includes hydrolytic degrading additives that promote hydrolytic degradation when exposed to an excess volume of water. As the film degrades, the excess volume of water is able to penetrate and dissolve the polyvinyl alcohol outer layer 14. In other words, the polymeric film protects the polyvinyl alcohol until the film is sufficiently degraded upon exposure to an excess volume of water, e.g. toilet water.

As described previously, the container 12 includes an impervious outer layer 14 so that liquid waste does not leak therefrom until the outer layer 14 is flushed down a toilet. Further, the container 12 includes a permeable inner layer 26 having a configuration complementary to that of the outer layer 14 such that the inner layer 26 nests in the outer layer 14 (FIG. 2). It is understood that the inner layer 26 is spaced from the bottom 16 of the outer layer 14 (FIG. 3B) such that liquid waste may be collected in that space. The inner layer 26 does not extend upwardly all the way to the outer layer lip 20. The space between the inner 26 and outer 14 layers includes an absorbent core 28 having a combination of crystalline sodium polyacrylate and low-density cellulosic fiber material (FIG. 2). Sodium polyacrylate is a long-chain molecule that functions as a semi-permeable membrane which can absorb up to 800 times its weight in water. Of course, too much polyacrylate would absorb too great a volume of water when flushed, so a predetermined proportioned mixture of polyacrylate and cellulosic fiber is used. The absorbent core materials may be configured in sheet, balls, or fibers. An upper extent of the inner layer 26 is attached to an inner surface of the outer layer 14 with a soluble adhesive so as to sandwich the absorbent core 28 in place and so the inner 26 and outer 14 layers will separate when flushed.

In use, a potty liner 10 is positioned on a toddler potty chair prior to use. More particularly, it is anticipated that the container 12 may be inserted into the waste receptacle of a toddler potty chair such that the outer layer lip 20 mates with an upper edge of the receptacle. When a toddler uses the potty chair, liquid or solid waste is received therein and directed by the slope of the side wall 18 toward the inner layer 26 adjacent the bottom 16. Liquid waste is allowed to pass through the permeable inner layer 26 and is absorbed by the absorbent core 28. Liquid waste is incapable of passing through the impervious outer layer 14. In addition, liquid waste is incapable of initiating a degrading reaction of the polymeric film that is coated upon the outer layer 14. Therefore, the outer layer 14, which is formed of polyvinyl chloride, does not dissolve until the polymeric film hydrolytically degrades sufficiently when deposited in the excess volume of water of a toilet.

Figure 5:
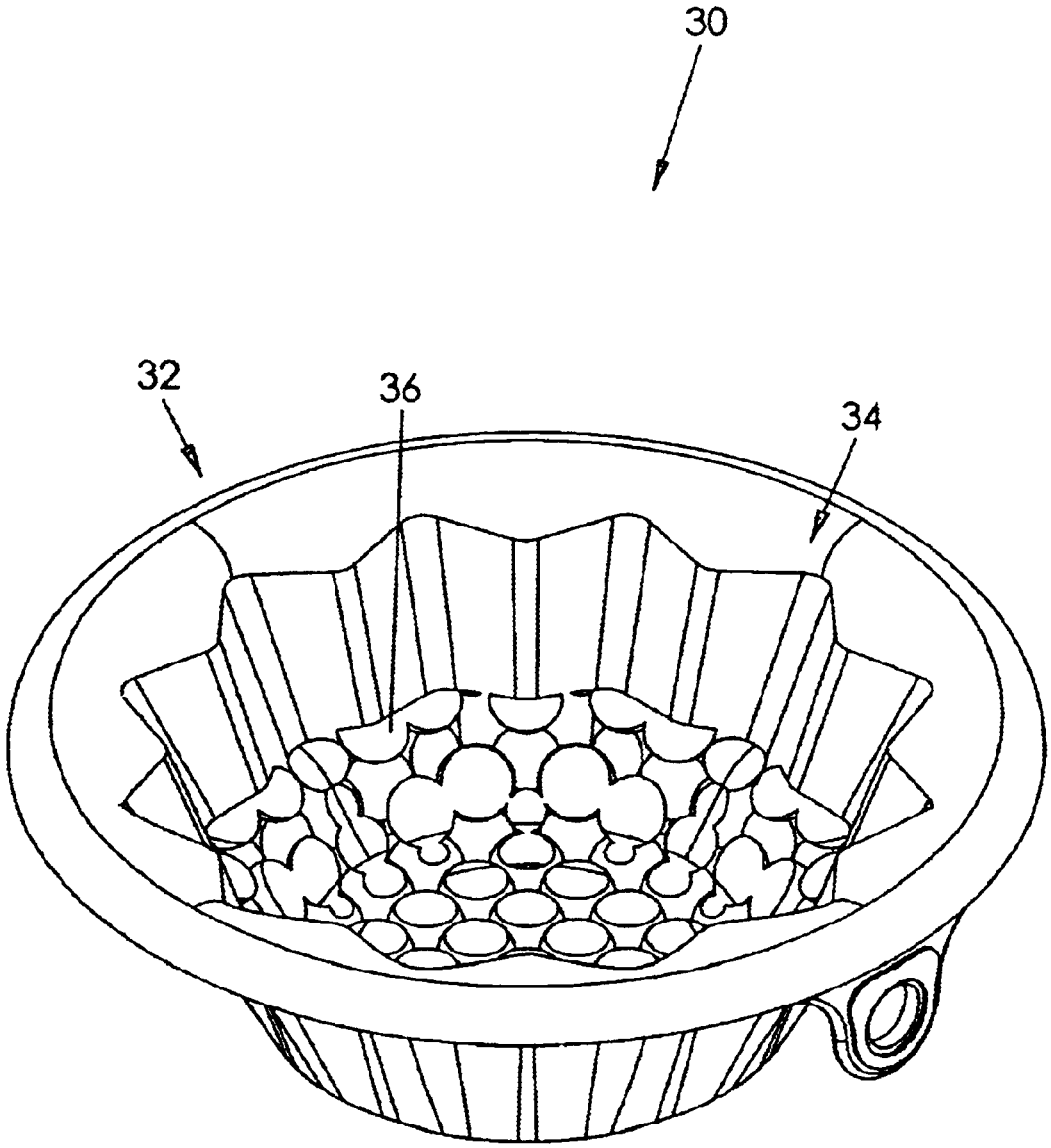
FIG. 5 is a perspective view of a potty chair liner according to another embodiment of the present invention.
Figure 6:
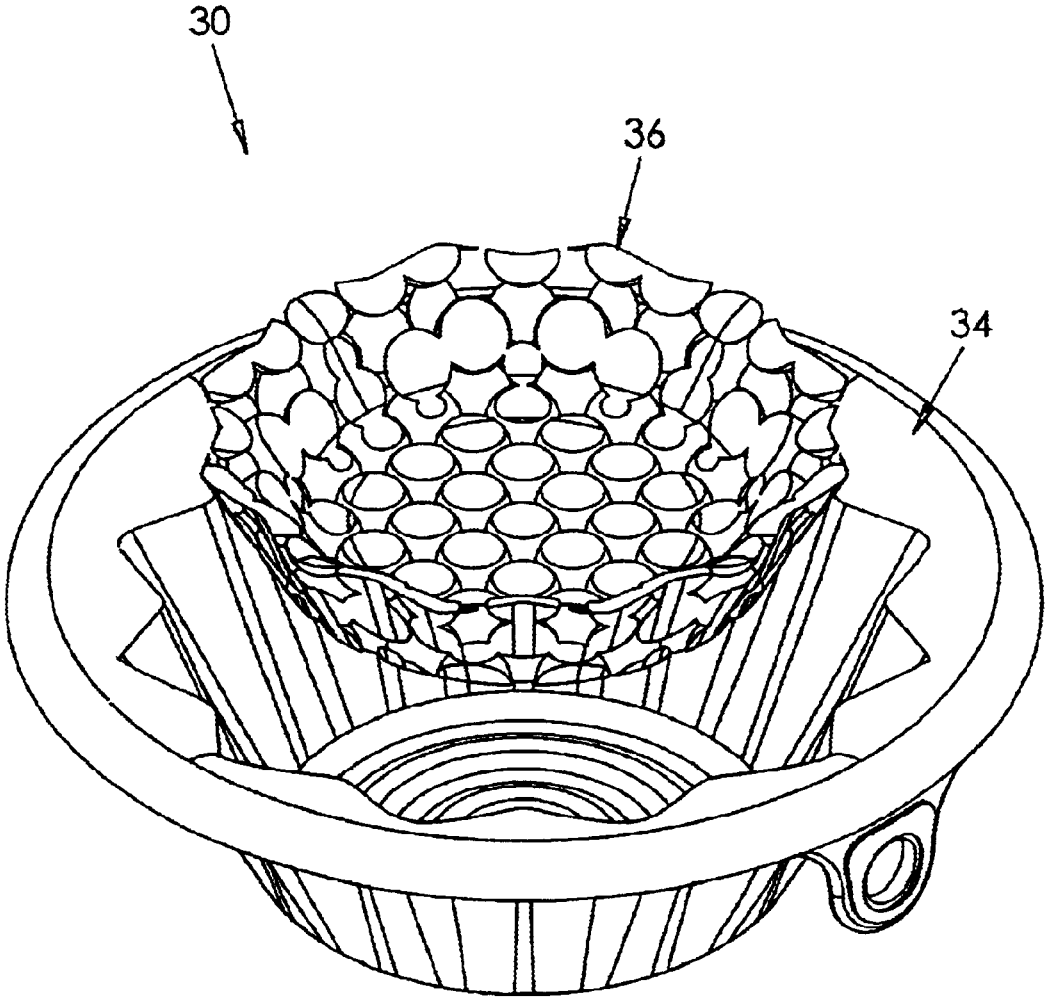
FIG. 6 is an exploded view of the liner as in FIG. 5.

A potty chair liner 30 according to another embodiment is shown in FIGS. 5 and 6 and includes a construction substantially similar to a construction of the potty liner 10 described previously except as specifically noted below. This potty chair liner 30 includes a container 32 having only two layers. The container 32 includes an outer layer 34 having a construction substantially similar to that described above. The container 32 also includes an absorbent core 36 substantially similar to that described above. However, no permeable inner layer is included. The absorbent core 36 is adhesively attached to an inner surface of the outer layer 34 and all waste received in the container 32 directly contacts the absorbent core 36, liquid waste being substantially absorbed of course.

It should be appreciated that the liner described herein may be modified for use with toiletry structures other than just toddler potty chairs. For example, the flushable liner structures described previously may be used with bedpans, portable or bedside commodes, and other similar devices where a flushable and disposable waste collection liner is desirable. Therefore, any references made herein to a toddler potty chair or toddler toilet seat should be deemed synonymous with these other similar toiletry structures.

It is understood that while certain forms of this invention have been illustrated and described, it is not limited thereto except insofar as such limitations are included in the following claims and allowable functional equivalents thereof.

Having thus described the invention, what is claimed as new and desired to be secured by Letters Patent is as follows:

1. A potty chair liner for use with a toddler toilet chair, comprising:

a waste receiving container having an impervious outer layer, a permeable inner layer, and an absorbent core between said outer and inner layers;

said outer layer having a closed bottom and a continuous side wall extending upwardly from said bottom, said side wall having an upper peripheral lip for resting atop the toddler toilet chair and defining an open top;

wherein said outer layer is constructed of a water soluble material coated with a polymeric film having hydrolytic degradability additives that allow said water soluble material to dissolve only when said polymeric film is exposed to an excess volume of water;

wherein said absorbent core includes a sheet of polyacrylate crystals and low-density woven cellulosic fibers;

a pair of laterally spaced apart tabs connected to said lip of said outer layer of said container for grasping by a user, at least one tab having an adhesive coating for selectively adhering said pair of tabs to one another for sanitary disposal of said container;

wherein said lip includes a generally concave configuration relative to a rim of a toddler toilet chair waste receptacle for positioning said container thereon;

wherein said inner layer includes a height smaller than a height of said side wall of said outer layer; and wherein said bottom includes a diameter smaller than a diameter of said open top such that said side wall includes a sloped configuration therebetween for directing waste toward said bottom.

2. The potty chair liner as in claim 1 wherein said bottom and said side wall of said outer layer include pleated configurations, respectively, for minimizing cohesion between said bottom and said side wall and the toddler toilet chair, whereby to reduce the amount of force required to remove said container from the toddler toilet chair following receiving waste therein.

3. The potty chair liner as in claim 1 wherein said water soluble material is polyvinyl alcohol.

* * * * *

UNITED STATES PATENT AND TRADEMARK OFFICE

CERTIFICATE OF CORRECTION

PATENT NO. : 6,738,991 B1
DATED : May 25, 2004
INVENTOR(S) : Dandreo et al.

It is certified that error appears in the above-identified patent and that said Letters Patent is hereby corrected as shown below:

Title page,
Item [73], Assignee, add the following,
-- Dandreo, Julie E.
1004 S. Olive St.
Ottawa, KS 66067
Dandreo, Daniel W.
1004 S. Olive St.
Ottawa, KS 66067 --

Signed and Sealed this

Seventh Day of December, 2004

JON W. DUDAS
*Director of the United States Patent and Trademark Office*